United States Patent [19]

Verega

[11] 4,274,231

[45] Jun. 23, 1981

[54] METHOD AND APPARATUS FOR DRESSING A GRINDING WHEEL

[75] Inventor: James Verega, Cicero, Ill.

[73] Assignee: Boyar-Schultz Corporation, Broadview, Ill.

[21] Appl. No.: 971,641

[22] Filed: Dec. 20, 1978

[51] Int. Cl.[3] ..... B24B 53/14

[52] U.S. Cl. ..... 51/165.71; 51/5 D; 51/325; 125/11 CD; 125/11 PH

[58] Field of Search ..... 51/165 R, 5 D, 325, 51/165.71; 125/11 R, 11 CD, 11 PH

[56] References Cited

U.S. PATENT DOCUMENTS

| | | | |
|---|---|---|---|
| 2,395,139 | 2/1946 | Nord et al. | 125/11 CD |
| 2,458,605 | 1/1949 | Kirin | 125/11 CD |
| 2,477,418 | 7/1949 | Polk | 125/11 CD |
| 2,482,785 | 9/1949 | Lohutko | 125/11 CD |
| 2,495,492 | 1/1950 | Wilson | 125/11 CD |
| 3,407,800 | 10/1968 | Hoare | 125/11 R |
| 3,584,616 | 6/1971 | Flohr | 125/11 CD |
| 4,073,281 | 2/1978 | Asaeda | 125/11 CD |

*Primary Examiner*—Harold D. Whitehead

*Attorney, Agent, or Firm*—Leydig, Voit, Osann, Mayer & Holt, Ltd.

[57] ABSTRACT

An intricate profile is formed on the peripheral face of the grinding wheel of a surface grinder by moving two rotatable and differently shaped dressing wheels axially and sequentially across the face of the grinding wheel while shifting the grinding wheel vertically in timed relation with such movement to control the depth of cut of the dressing wheels into the grinding wheel. The dressing wheels are movable with the crossfeed carriage of the grinder while vertical movement of the grinding wheel during the dressing operation is effected by way of the wheelhead of the grinder. Both motions are controlled during the dressing operation by a computerized numerical control.

4 Claims, 5 Drawing Figures

20 10 0 90 80
21
20
18
22
12
11
15
16
Z
X
3
40
48
23
23
24
24
27
45
50
52
54
30
30
31
31
30
34
17

METHOD AND APPARATUS FOR DRESSING A GRINDING WHEEL

BACKGROUND OF THE INVENTION

This invention relates generally to a grinding machine and more particularly to a grinding machine of the type in which a grinding wheel feeds into a workpiece to establish the depth of cut and in which the workpiece is adapted to be positioned transversely relative to the grinding wheel by a table or the like. The grinding wheel and the table usually are moved by power-operated actuators which may be controlled automatically by a computerized numerical control or the like.

The invention has more specific reference to method and apparatus for dressing the grinding wheel of such a machine and particularly for forming the wheel with a profiled contour defined by alternating ribs and grooves of various sizes and shapes. One method of forming such a profile on the wheel is referred to as crushroll dressing. In that method, the grinding wheel is plunged into and is rotated against a roller having a performed profile which is complementary with the intended profile of the wheel. A different roller is, of course, required for each different profile which is to be formed on the wheel.

SUMMARY OF THE INVENTION

The general aim of the present invention is to provide new and improved method and apparatus which makes unique advantageous use of the grinding machine and its automatic control to enable the grinding wheel to be dressed rapidly, with a high degree of precision and with virtually any desired without need of changing dressing tools to form the various profiles.

A more detailed object of the invention is to achieve the foregoing by dressing the grinding wheel with at least one and preferably two rotatable dressing wheels which move along two mutually perpendicular axes relative to the grinding wheel under the control of the same automatic control which controls movement of the grinding wheel and the table during a grinding operation, the dressing wheels being uniquely positioned relative to the grinding wheel to enable the latter to be profiled with ribs and grooves of various sizes and shapes.

Still another object of the invention is to reduce the cost of incorporating the dressing wheels into the grinding machine by utilizing the table of the machine to produce relative movement of the dressing wheels and the grinding wheel along one axis and by utilizing the normal feed and retract motion of the grinding wheel to produce relative movement of the dressing wheels and the grinding wheel along the other axis.

These and other objects and advantages of the invention will become more apparent from the following detailed description when taken in conjunction with the accompanying drawings.

DETAILED DESCRIPTION OF THE PREFERRED EMBODIMENT

Figure 1:
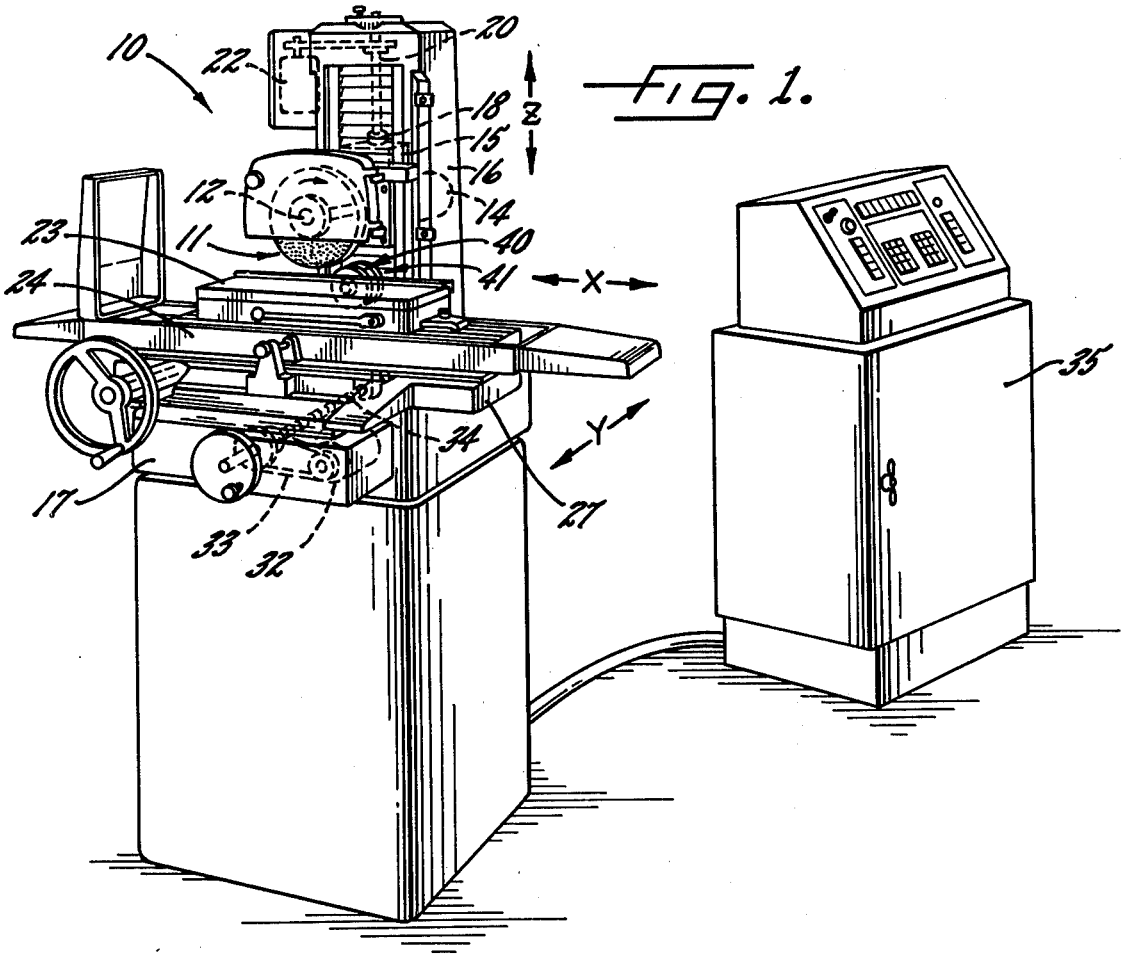
FIG. 1 is a perspective view showing a new and improved grinding machine incorporating the unique features of the present invention.

For purposes of illustration, the invention is shown in the drawings in conjunction with a surface grinding machine 10 in which a grinding wheel 11 rotates about its own axis to grind the upper surface of a workpiece (not shown) located beneath the grinding wheel. The grinding wheel is fixed to and rotates with a horizontal spindle 12 (FIG. 3) journaled within a bearing housing 13 and adapted to be driven by an electric motor 14.

Figure 2:
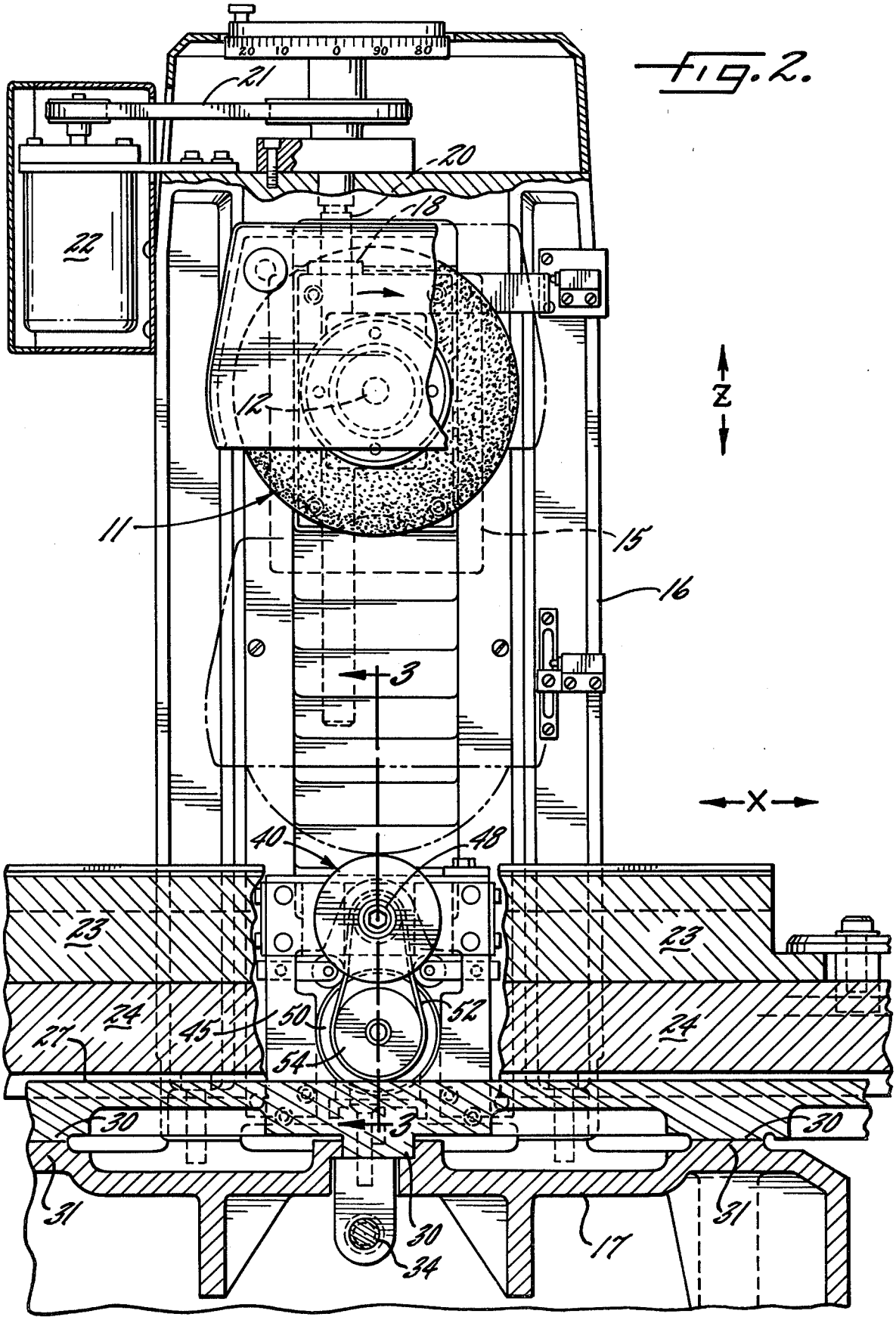
FIG. 2 is an enlarged fragmentary front elevational view of the machine shown in FIG. 1 with certain parts of the machine being broken away and shown in section.

Both the bearing housing 13 and the motor 14 are carried by a head 15 (FIG. 3) which is guided for up and down movement within a upright column 16 fixed to and upstanding from a rigid bed 17. A rotatable nut 18 (FIG. 2) is fixed vertically relative to the head and is threaded onto a vertical lead screw 20 journaled within the column and connected by way of a belt drive 21 to a reversible power-operated actuator 22. In the present instance, the actuator 22 is an electric stepping motor which is supported by the column 16. Rotation of the lead screw in one direction feeds the grinding wheel 11 downwardly into the workpiece while rotation in the opposite direction retracts the grinding wheel upwardly to permit the workpiece to be re-positioned under or removed from beneath the wheel. The up and down movement of the grinding wheel is conventionally referred to as movement along a Z-axis.

The workpiece is adapted to be held by a magnetic chuck 23 mounted on the bed 17 in such a manner that the chuck and the workpiece supported thereon may be moved both crosswise of the grinding wheel (i.e., along a Y-axis extending parallel to the axis of the wheel) and longitudinally of the wheel (i.e., along an X-axis extending perpendicular to the axis of the wheel). For this purpose, the chuck is attached to a table 24 formed with longitudinally extending V-shaped ways 25 (FIG. 3) adapted to slide on complementary ways 26 formed in an underlying carriage 27. The carriage 27, in turn, is formed with transversely extending flat ways 30 (FIG. 2) which are supported and guided by underlying ways 31 on the bed 17. Tranverse or crosswise movement of the carriage 27, the table 24 and the chuck 23 along the Y-axis is effected by a reversible power-operated actuator in the form of an electric stepping motor 32 (FIG. 1) which acts through a belt drive 33 to rotate a lead screw 34 (FIGS. 1 and 2) operably connected to the carriage. A similar stepping motor and lead screw (not shown) may be utilized to move the table 24 longitudinally on the carriage along the X-axis.

Control of the Z-axis downfeed motor 22, the Y-axis crossfeed motor 32 and, if desired, the X-axis motor is effected automatically and preferably by a computerized numerical control (CNC) unit 35 (FIG. 1). CNC units are well known and thus the construction and operation of the controller 35 need not be described in detail here. It will suffice to say that the controller may be programmed to produce output pulses which are transmitted to the various stepping motors to effect movement of the grinding wheel head 15, the table 24 and the carriage 27 at designated times and through designated distances. In this way, the grinding machine 10 may be cycled through a predetermined operating sequence which might consist of, by way of example only, crosswise positioning of the workpiece beneath the grinding wheel, downfeeding of the wheel, longitudinal stroking of the workpiece while continuing the downfeeding and then retraction of the wheel preparatory to feeding the workpiece to a new transverse position.

In many instances, the operating sequence described above is followed when it is desired to grind a predetermined contour or profile in the workpiece. For example, the peripheral face of the wheel 11 may be dressed in such a manner as to be formed with irregularly shaped and alternating ribs 36 and grooves 37 (FIG. 5) which are used to contour grind complementary grooves and ribs formed in a slot in the workpiece.

The present invention contemplates the provision of a new and improved method which enables the peripheral face of the grinding wheel 11 to be dressed quickly and easily and which is particularly well-suited for forming intricate profiles on the face of the wheel. The wheel dressing method of the invention is further characterized by the fact that it uses to good advantage the coordinate movements of the grinding wheel 11 and the carriage 27 and also utilizes the precise control which the CNC unit 35 maintains over such movements.

Figure 4:
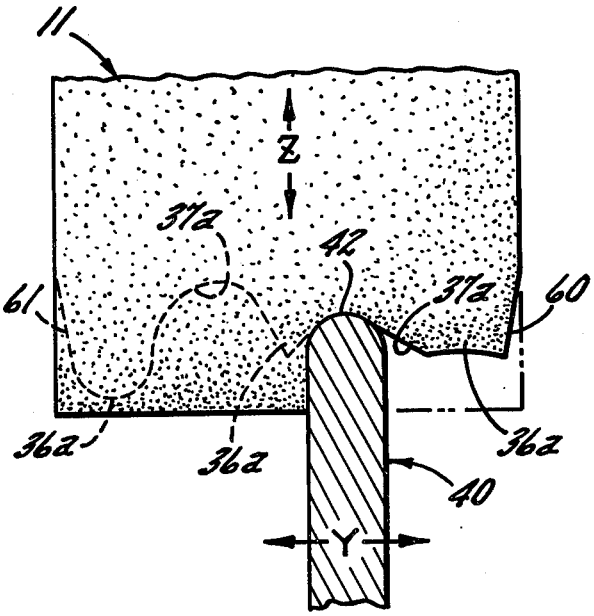
FIGS. 4 and 5 are views showing the progressive steps which are followed in the preferred method of dressing the grinding wheel.
Figure 5:
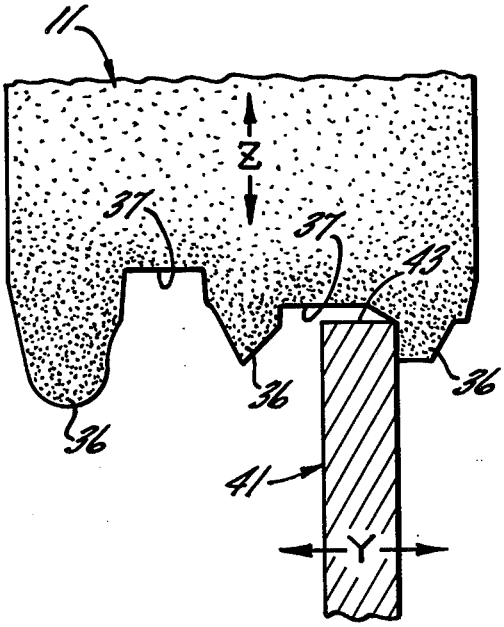
Figure 3:
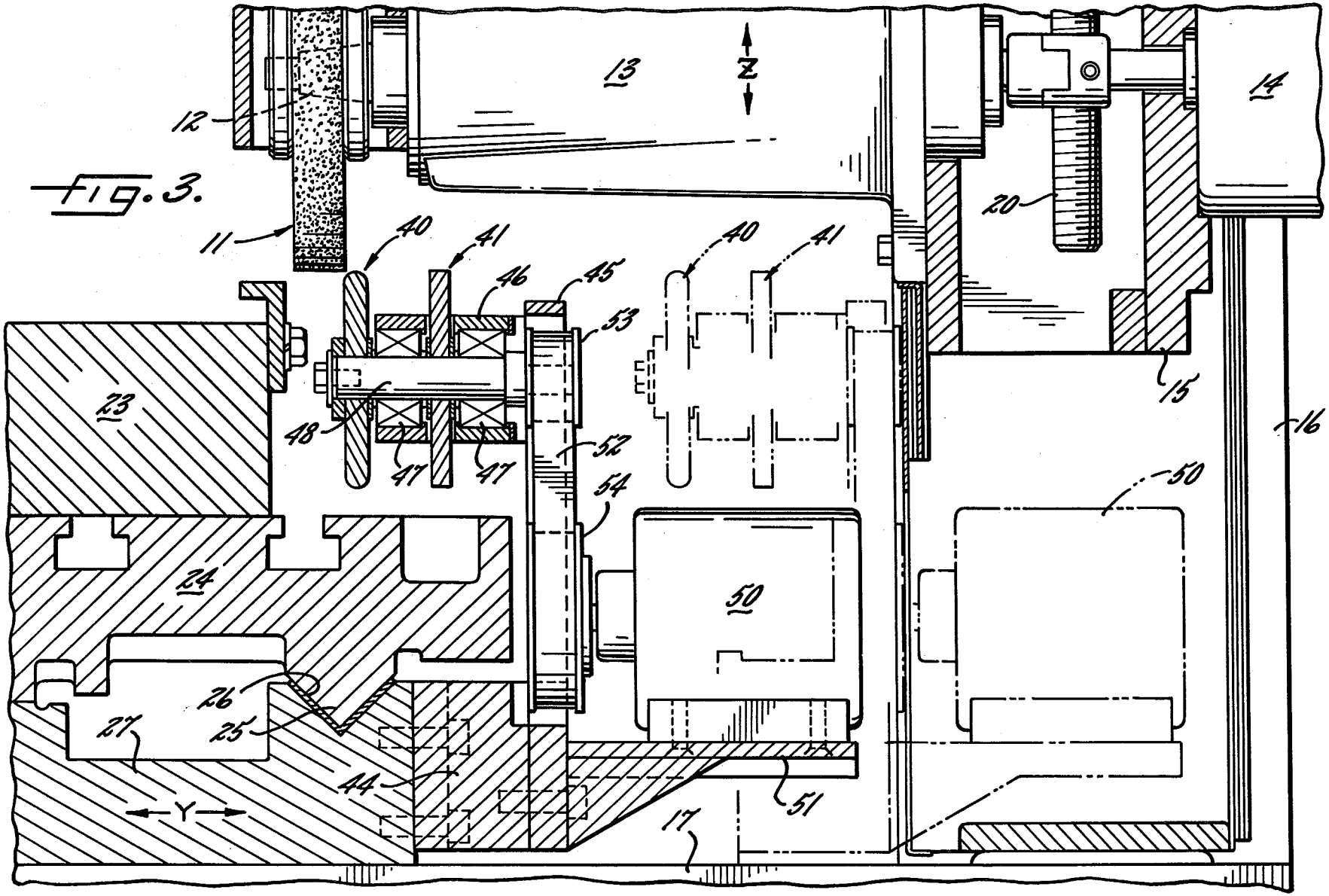
FIG. 3 is a fragmentary cross-section taken substantially along the line 3—3 of FIG. 2.

In the preferred manner of carrying out the invention, the grinding wheel 11 is profiled in a two-step operation with the first step being performed by a dressing tool 40 and with the second step being performed by a different dressing tool 41 (FIGS. 3 to 5). Herein, each dressing tool takes the form of a wheel made from diamond particles which are bonded together by a suitable cement. The two wheels 40 and 41 are identical except for the profiles of their peripheral faces 42 and 43. As shown in FIGS. 4 and 5, the peripheral face 42 of the wheel 40 is radiused so as to be convex in cross-section while the peripheral face 43 of the wheel 41 is flat or straight in cross-section. The axial width of the peripheral face of each dressing wheel is less than half the axial width of the peripheral face of the grinding wheel 11.

Advantageously, the dressing wheels 40 and 41 are oriented with their axes extending parallel to and spaced below the axis of the grinding wheel 11 and are supported to move axially of the grinding wheel when the carriage 27 is shifted along the Y-axis by the stepping motor 32. For these purposes, a mounting block 44 (FIG. 3) is attached rigidly to the rear side of the carriage 27 and supports an upstanding bracket 45 (FIG. 2) of inverted U-shaped construction. Secured to and projecting forwardly from the upper end portion of the bracket is a bearing housing 46 (FIG. 3) which supports a pair of axially spaced bearings 47. A horizontal shaft 48 is journaled in the bearings and extends through the two dressing wheels 40 and 41, the latter being rotatable with the shaft and being spaced axially from one another by a distance greater than the axial width of the grinding wheel 11. The shaft 48 extends parallel to the spindle 12 of the grinding wheel and locates the dressing wheels in a six o'clock position relative to the grinding wheel and at approximately the same elevation as the magnetic chuck 23. The axes of the spindle and the shaft thus are disposed in a common vertical plane.

Rotation of the dressing wheels 40 and 41 is effected by an electric motor 50 (FIG. 3) which is supported on a rearwardly projecting bracket 51 rigid with the mounting block 43. An endless belt 52 is trained around and tensioned between a pulley 53 on the rear end portion of the shaft 48 and a second pulley 54 on the output shaft of the motor to transmit drive from the motor to the dressing wheels.

During a normal grinding operation, the dressing wheels 40 and 41 are disposed rearwardly of the grinding wheel 11 with the dressing wheels being located as shown in phantom lines FIG. 3 when the carriage 27 is positioned to enable the grinding wheel to grind the extreme forward portion of the workpiece. In order to form the grinding wheel 11 with the profile which is shown, for example, in FIG. 5, the carriage 27 is moved forwardly along the Y-axis by the stepping motor 32 and, under the control of the CNC unit 35, is stopped when the forward face of the radiused dressing wheel 40 is just short of the downward path of the grinding wheel. Also, the grinding wheel is moved downwardly by the stepping motor 22 and is stopped by the CNC unit 35 when the grinding wheel is at an elevation to establish the proper depth of the initial cut of the dressing wheel 40 into the grinding wheel.

The first step of the actual dressing operation is effected by moving the dressing wheel 40 axially or from rear to front across the peripheral face of the grinding wheel 11 while shifting the grinding wheel upwardly and downwardly in precisely timed relation with such movement to control the depth of cut at various locations across the peripheral face of the grinding wheel as both wheels 11 and 40 are rotated by their respective motors 14 and 50. The timed relationship between the movements is established by the CNC unit 35 with the vertical movement of the grinding wheel occurring along a path which is perpendicular to the axes of the grinding wheel and the dressing wheel 40. During the first phase of the dressing operation, the front face of the dressing wheel 40 may initially relieve the rear face of the grinding wheel 11 as indicated at 60 in FIG. 4 and then the peripheral face 42 of the dressing wheel may proceed across the peripheral face of the grinding wheel to form the various radiused ribs **36*a* and grooves 37*a* shown in FIG. 4. As the dressing wheel 40 completes its forward pass, the forward face of the grinding wheel may be relieved as indicated at 61 in FIG. 4**.

After the wheel 40 has completed the first step of the dressing operation, the dressing wheel 41 may be traversed across the grinding wheel 11 to remove some of the radiused surfaces formed by the dressing wheel 40 and to cause portions of the ribs 36 and grooves 37 to be shaped with flat surfaces and with sharp or right angular corners. The ultimate profile of the grinding wheel after completion of the operation by the dressing wheel 41 is shown in FIG. 5. In forming the various corners and flat surfaces, the dressing wheel 41 does not necessarily move continuously from rear to front across the grinding wheel but instead may make an idle rear-to-front stroke across a portion of the grinding wheel and then perform the dressing operation on that portion while being moved from front to rear. An inspection of the contour shown in FIG. 5 makes it apparent that the coaction of the two dressing wheels enables the formation of an extremely intricate profile on the peripheral face of the grinding wheel.

From the foregoing, it will be appreciated that the present invention brings to the art an improved wheel dressing method which is capable of forming a complex profile in a grinding wheel 11 in a comparatively rapid manner and without need of providing a special dressing tool for each desired profile. The surface grinding machine 10 may be easily and economically adapted to carry out the method of the invention by virtue of the fact that the method utilizes the movements of the existing head 15 and the existing carriage 27 along with the control effected by the CNC unit 35.

I claim:

1. A method of forming ribs and grooves of a predetermined contour in the peripheral face of a grinding wheel, said method comprising the steps of, rotating the grinding wheel about a horizontal axis coinciding with the axis of the grinding wheel, rotating a pair of dressing wheels about a common horizontal axis spaced downwardly from and extending parallel to the axis of said grinding wheel and coinciding with the axes of the dressing wheels, the axis of said grinding wheel and the axes of said dressing wheels being located in a common vertical plane, the dressing wheels being spaced axially from one another by a distance greater than the axial width of said grinding wheel and having differently shaped peripheral faces of lesser axial width than the axial width of the grinding wheel, said method further comprising the steps of shifting said dressing wheels bodily along their axes of cause the face of one dressing wheel to pass across the face of said grinding wheel and thereafter to cause the face of the other dressing wheel to pass across the face of the grinding wheel, and moving the axis of the grinding wheel bodily within said vertical plane and toward and away from the axes of the dressing wheels as the face of each dressing wheel passes across the face of the grinding wheel thereby to change the depth of cut of the dressing wheel into the grinding wheel.

2. A method of profiling the peripheral face of a grinding wheel, said method comprising the steps of, rotating the grinding wheel about a horizontal axis coinciding with the axis of the grinding wheel, rotating a dressing wheel about a horizontal axis spaced downwardly from and extending parallel to the axis of said grinding wheel and coinciding with the axis of the dressing wheel, the axis of said grinding wheel and the axis of said dressing wheel being located in a common vertical plane, said method further comprising the steps of shifting said dressing wheel bodily along its axis to cause the face of the dressing wheel to pass across the face of said grinding wheel, and moving the axis of the grinding wheel bodily within said vertical plane and toward and away from the axis of the dressing wheel as the face of the dressing wheel passes across the face of the grinding wheel thereby to change the depth of cut of the dressing wheel into the grinding wheel.

3. A grinding machine having a powerdriven grinding wheel rotatable about a generally horizontal axis which coincides with the axis of the wheel, a generally horizontal table underlying said grinding wheel and adapted to support a workpiece, a first reversible power-operated actuator for moving said grinding wheel upwardly and downwardly along a generally vertical path to establish the depth of cut of the grinding wheel into the workpiece, a second reversible power-operated actuator for moving said table transversely back and forth along a generally horizontal axis extending parallel to the axis of said grinding wheel to traverse the workpiece across the peripheral face of the grinding wheel, and two dressing wheels for dressing the peripheral face of said grinding wheel, said grinding machine being characterized in that said dressing wheels are movable transversely with said table and are mounted on said table to rotate about a common and generally horizontal axis coinciding with the axis of each dressing wheel and located below and extending parallel to the axis of said grinding wheel, the rotational axis of said dressing wheels being located in a common vertical plane with the rotational axis of said grinding wheel, said dressing wheels being located adjacent to but being spaced axially from one another with the axial spacing between the adjacent dressing wheels being greater than the axial width of said grinding wheel, the peripheral faces of said dressing wheels being of different shape and being of lesser axial width than the axial width of said grinding wheel, and power-operated means movable with said table for rotating said dressing wheels about their rotational axis whereby the peripheral face of said grinding wheel may be dressed by rotating all wheels about their respective axes, by moving said table transversely with said second actuator to traverse first one dressing wheel and then the other dressing wheel across said grinding wheel, and by moving said grinding wheel upwardly and downwardly with said first actuator to control the depth of cut of each dressing wheel into said grinding wheel.

4. A grinding machine as defined in claim 3 in which the peripheral face of one of said dressing wheels is convex in cross-section, the peripheral face of the other dressing wheel being flat in cross-section.

* * * * *